US008794619B2

(12) United States Patent
Yoshimura

(10) Patent No.: US 8,794,619 B2
(45) Date of Patent: Aug. 5, 2014

(54) SHEET FEEDING APPARATUS AND IMAGE FORMING APPARATUS

(75) Inventor: Yuri Yoshimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/300,443

(22) Filed: Nov. 18, 2011

(65) Prior Publication Data

US 2012/0133096 A1 May 31, 2012

(30) Foreign Application Priority Data

Nov. 26, 2010 (JP) ..... 2010-264222

(51) Int. Cl.
*B65H 1/00* (2006.01)

(52) U.S. Cl.
USPC ..... 271/162

(58) Field of Classification Search
USPC ..... 271/162, 145; 312/215, 222; 292/216, 292/232; 399/110, 393
See application file for complete search history.

(56) References Cited

U.S. PATENT DOCUMENTS

2009/0057975 A1* 3/2009 Uchida ..... 270/1.01

FOREIGN PATENT DOCUMENTS

| | | | |
|---|---|---|---|
| JP | 2-178121 | * | 7/1990 |
| JP | 11-301861 | A | 11/1999 |
| JP | 2002-154674 | * | 5/2002 |
| JP | 2002-302274 | * | 10/2002 |

* cited by examiner

*Primary Examiner* — Thomas Morrison
(74) *Attorney, Agent, or Firm* — Canon USA Inc IP Division

(57) ABSTRACT

The invention is directed to providing a sheet feeding apparatus including a stop mechanism configured to stop a sheet storage unit while the sheet storage unit is being drawn out from an apparatus main body, a stop release mechanism configured to release stop of the sheet storage unit by a stop mechanism and to enable detachment from the apparatus main body, a holding mechanism configured to hold a release state using the stop release mechanism of the stop of the sheet storage unit by the stop mechanism, and a return mechanism configured to release the holding of the release state of the stop mechanism by the holding mechanism while the sheet storage unit is being attached to the apparatus main body, and to return the sheet storage unit to a stop state using the stop mechanism.

16 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus that feeds a sheet to an image forming unit in an image forming apparatus and, in particular, to a drawing out mechanism of a sheet storage unit disposed in the sheet feeding apparatus.

2. Description of the Related Art

Conventionally, with a widespread image forming apparatus such as a copying machine, a printer, or a facsimile machine, sheets are fed one by one from a sheet feeding apparatus that stores sheets to an image forming unit and an image is formed thereon. With the sheet feeding apparatus, in general, the uppermost sheet is separated from the sheets stored in a sheet storage unit such as a sheet feeding cassette or a sheet feeding deck disposed in a main body of the sheet feeding apparatus. Then, the sheets are automatically fed one by one.

Recently, for the image forming apparatus, a sheet feeding apparatus is increasingly demanded to store a large amount of sheets and feed the sheets in response to a request to form an image to a large amount of sheets or a request to save the trouble for replenishing sheet. For example, an image forming apparatus is increasingly demanded to stack 1000, 2000, or more sheets to a sheet storage unit (such as a sheet feeding deck with a large capacity) and to then feed the sheets.

With the sheet feeding apparatus, the sheet storage unit that stores a large amount of sheets is greatly heavy. When drawing out the sheet storage unit from an apparatus main body for the purpose of sheet replenishment, sheet exchange, or status check of the sheet storage unit, a user completely draws out the sheet storage unit. Then, the user has to lift up the sheet storage unit and a burden of the user is greatly large. Preferably, the sheet storage unit can stop when the sheet storage unit is drawn out with a predetermined amount without completely detaching the sheet storage unit from the main body of the sheet feeding apparatus. On the other hand, the sheet storage unit can be detached from the apparatus main body for the purpose of exchange of parts therein.

Then, it is discussed that a sheet storage unit stops when drawing out the sheet storage unit with a predetermined amount at a usual drawing out time of the sheet storage unit, such as sheet replenishment or sheet exchange. Further, the sheet storage unit is fully detached from the apparatus main body if necessary. For example, Japanese Patent Application Laid-Open No. 11-301861 discusses that a stop member is disposed to abut on a sheet storage unit and stop the sheet storage unit before drawing out the sheet storage unit from an apparatus main body. Further, the stop member is rotated, thereby releasing the abutment state on the sheet storage unit, and the sheet storage unit is drawn out from the apparatus main body. Moreover, US Patent Application Publication No. 2009/0057975 discusses that a latch member that stops a sheet storage unit before the sheet storage unit is drawn out from an apparatus main body. Further, when drawing out the sheet storage unit from the apparatus main body, the sheet storage unit is obliquely lifted up to release the latch state with the latch member.

However, as discussed in Japanese Patent Application Laid-Open No. 11-301861, the following problem occurs in a configuration to release an abutment state between the sheet storage unit and the stop member with the rotation thereof when detaching the sheet storage unit from the apparatus main body. Specifically, with the configuration, when drawing out the sheet storage unit from the apparatus main body, the stop member is rotated simultaneously with an operation for drawing out the sheet storage unit. In the case where the sheet storage unit has a large capacity, the operability is low because a user must rotate the stop member while supporting the front side of the heavy sheet storage unit that stacks a large amount of sheets.

In addition, as discussed in US Patent Application Publication No. 2009/0057975, the following problem occurs in the configuration to draw out the sheet storage unit by obliquely lifting up the sheet storage unit to release the latch state with the latch member. In other words, with the configuration, when drawing out the sheet storage unit from the apparatus main body, it is required to lift up the sheet storage unit to release the latch state with the latch member and further draw out the sheet storage unit obliquely upward. The operability is also low because it is required to draw out the sheet storage unit with a large capacity while the sheet storage unit is lifting up obliquely.

With the configurations, the sheet storage unit can be detached from the apparatus main body if the sheet storage unit fully stacks sheets. Therefore, if the sheet storage unit with the large capacity is heavy beyond user expectation, there is a danger that the sheet storage unit can carelessly fall and a setting surface can be thus damaged or the sheet storage unit can be damaged.

SUMMARY OF THE INVENTION

The present invention is directed to enabling the release of stop or the detachment of a sheet storage unit with a large capacity by a simple user operation while the sheet storage unit is being drawn out.

According to an aspect of the present invention, a sheet feeding apparatus has a sheet storage unit configured to store a sheet and being detachable by being drawn out from an apparatus main body, and a sheet feeding unit configured to feed the sheet from the sheet storage unit. The sheet feeding apparatus includes a stop mechanism configured to stop the sheet storage unit while the sheet storage is being drawn out unit from the apparatus main body, a stop release mechanism configured to release stop of the sheet storage unit by the stop mechanism and to enable detachment of the sheet storage unit from the apparatus main body, a holding mechanism configured to hold a release state using the stop release mechanism of the stop of the sheet storage unit by the stop mechanism, and a return mechanism configured to release the holding of the release state of the stop mechanism by the holding mechanism while the sheet storage unit is being attached to the apparatus main body, and to return the sheet storage unit to a stop state using the stop mechanism.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A specific description is given of an exemplary embodiment of the present invention with reference to the drawings. It is possible to properly change the shape and relational arrangement of components in the exemplary embodiment depending on a configuration or conditions according to the present invention. The scope according to the present invention is not limited to the following exemplary embodiment.

Figure 1A:
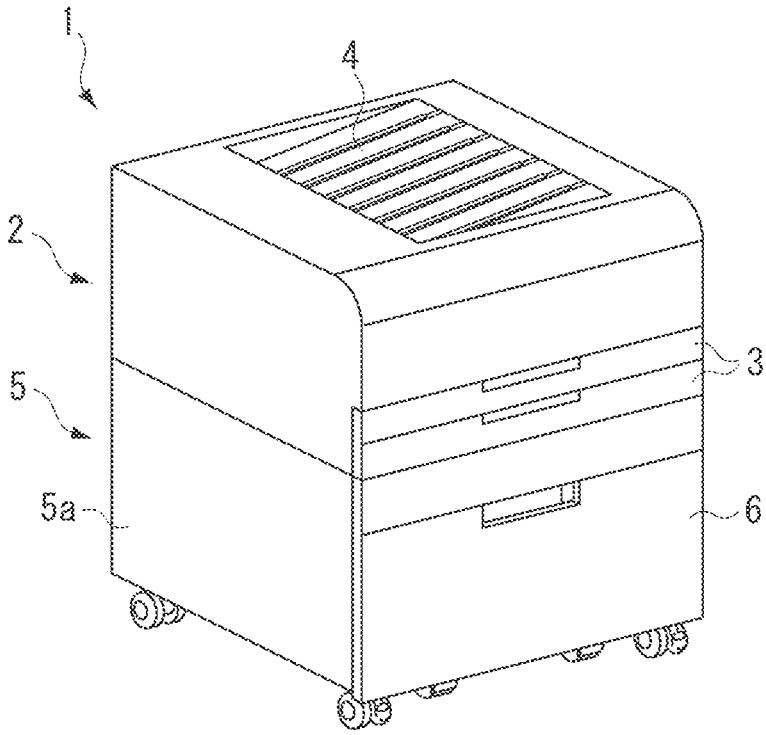
FIGS. 1A and 1B illustrate a perspective view and a longitudinal sectional view of an image forming apparatus according to an exemplary embodiment of the present invention.
Figure 1B:
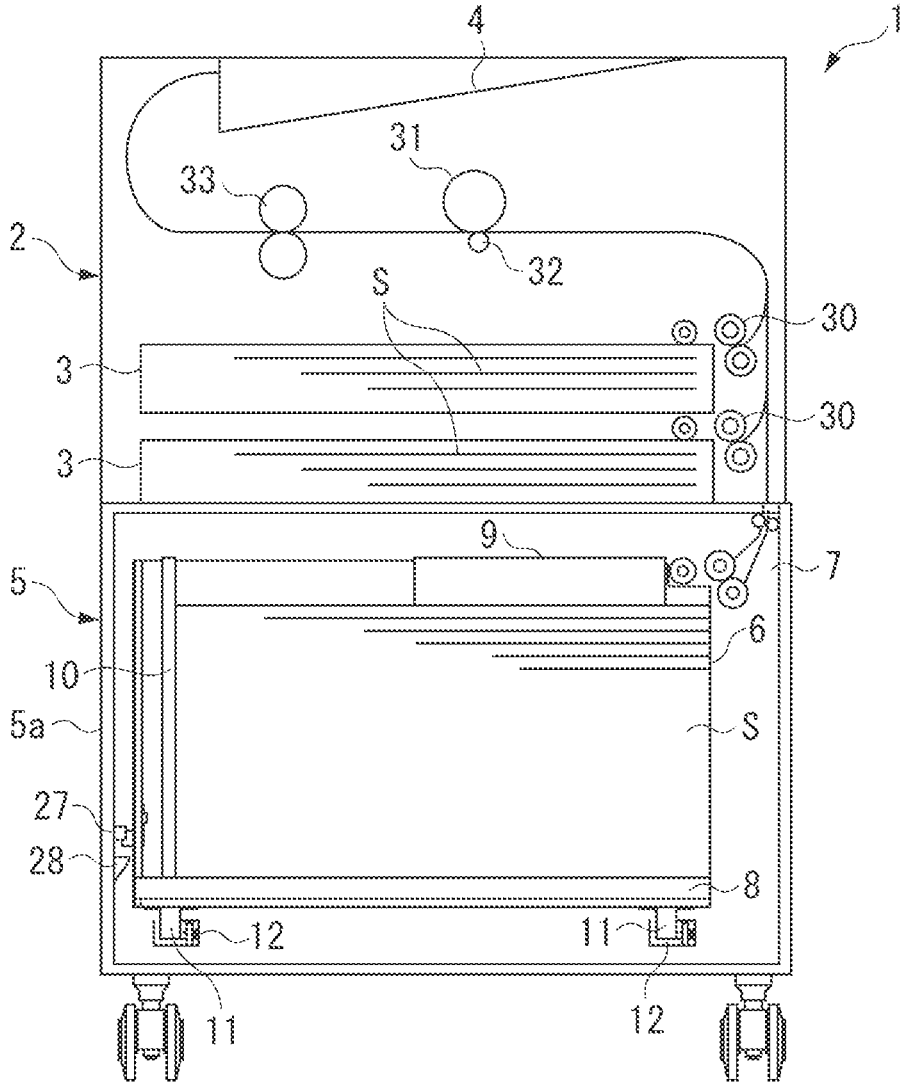

First of all, a description is given of a schematic configuration of an image forming apparatus to which a sheet feeding apparatus is attached according to the present invention with reference to FIGS. 1A and 1B. FIG. 1A illustrates an external perspective view of the image forming apparatus. FIG. 1B illustrates a longitudinal sectional view of the image forming apparatus.

An image forming apparatus 1 includes a sheet feeding apparatus 5 that feeds sheets to an image forming unit under a printer unit 2 which includes the image forming unit to form an image to the sheet. The printer unit 2 is first described.

Referring to FIG. 1B, the printer unit 2 includes a sheet feeding cassette 3 that stores a sheet S. Two sheet feeding apparatuses are arranged above and below to feed the sheets S to the image forming unit in the printer unit 2 from the sheet feeding cassette 3 with sheet feed units 30. The sheet feeding unit 30 includes a pickup roller that feeds the sheet S from the sheet feeding cassette 3, and a separation portion having a feed roller and a retard roller. The separation portion separates the sheet S fed by the pickup roller.

The sheet feeding unit 30 conveys the sheet S fed from the sheet feeding cassette 3 to a transfer portion (nip portion) between a built-in electrophotographic photosensitive drum 31 included in a process cartridge and a transfer roller 32 facing the photosensitive drum 31. The photosensitive drum 31 and the transfer roller 32 form the image forming unit. At the transfer portion, a toner image formed onto the surface of the photosensitive drum 31 is transferred to the conveyed sheet S. The sheet S on which the toner image is transferred at the transfer portion is conveyed to a fixing device 33. The fixing device 33 performs heating and pressurizing processing (fixing) of the toner image to the sheet S. The sheet on which the toner image is fixed by the fixing device 33 is discharged to a sheet discharge tray 4 set on an upper surface of the printer unit 2.

Figure 2:
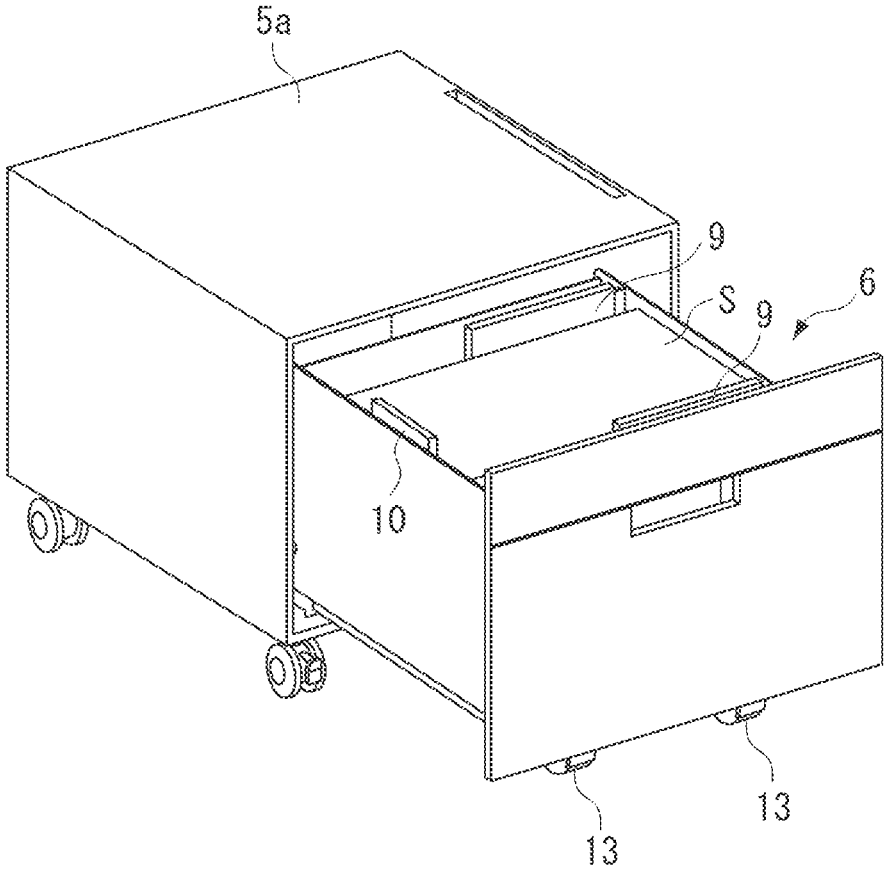
FIG. 2 illustrates a perspective view of a sheet feeding apparatus according to the exemplary embodiment of the present invention.

A description is given of the sheet feeding apparatus 5 with reference to FIG. 1B and FIG. 2. FIG. 2 illustrates a perspective view of the sheet feeding apparatus 5 from which the sheet storage unit 6 is drawn out.

The sheet feeding apparatus 5 includes the sheet storage unit (sheet feeding deck with a large capacity) 6 that stores the sheets S, and a sheet feeding unit 7 that feeds the sheets S stored in the sheet storage unit 6. The sheet storage unit 6 is detachably disposed in an apparatus main body 5*a* of the sheet feeding apparatus 5. The sheet storage unit 6 includes a stack plate 8 on which the sheets S are placed, a side regulation plate 9, and a trailing edge regulation plate 10. The side regulation plate 9 abuts on a side surface of the sheets S and regulates the position of the sheet S in the direction perpendicular to a sheet feeding direction. The trailing edge regulation plate 10 regulates the position of the sheet S on the rear side of the sheet feeding direction. A sheet feeding unit 7 separates and feeds the sheets S one by one. Further, the sheet feeding unit 7 includes a pickup roller that feeds the sheets S, and a separation portion that separates the sheets S fed by the pickup roller. The separation portion includes a feed roller and a retard roller.

The sheet feeding unit 7 feeds the sheets S to thus reduce the amount of stacked sheets on the stack plate 8. A lifter mechanism (not illustrated) is disposed to lift up the stack plate 8 and move the uppermost sheet to a sheet feedable position. In the lifter mechanism, a wire connected to the stack plate 8 is wound up to a pulley with rotation of a motor, thereby lifting up the stack plate 8. The lifter mechanism lifts up the stack plate 8 and the uppermost surface of the stacked sheets S reaches a predetermined position. Then, the sheet feeding unit 7 can separate and feed the sheet S. When the sheet storage unit 6 is drawn out from the apparatus main body 5*a* of the sheet feeding apparatus 5, the connection between the motor and the pulley is release. Due to weight of the stack plate 8 and the stacked sheets S, the stack plate 8 falls to the lower limit position.

The sheet storage unit 6 can be drawn out from the apparatus main body 5*a* with guide of an inner rail 11 disposed below the sheet storage unit 6 and an outer rail 12 disposed in the apparatus main body 5*a* of the sheet feeding apparatus 5. When the sheet storage unit 6 is drawing out, the amount of overlap between the inner rail 11 and the outer rail 12 is reduced. The front side of the sheet storage unit 6 slants downward in the drawing out direction due to self weight. Therefore, a caster 13 is disposed on the downside in the forward direction of the sheet storage unit 6. When the sheet storage unit 6 is drawing out, the caster 13 is landed on a floor surface of the apparatus installation to support the inclined sheet storage unit 6. Hereinbelow, the direction to draw out the sheet storage unit 6 from the apparatus main body 5*a* is forward, and the direction to attach the sheet storage unit 6 to the apparatus main body 5*a* is backward.

A description is given of a stop mechanism that stops the sheet storage unit 6 while the storage unit 6 is being drawn out from the apparatus main body 5*a*, a stop release mechanism that releases the stop of the sheet storage unit 6 by the stop mechanism, and an operation unit that operates the stop release mechanism. FIGS. 3A and 3B and FIGS. 4A and 4B illustrate perspective views of the sheet storage unit 6. All the views illustrate that the sheet S is not stacked to the stack plate 8.

The sheet storage unit 6 is configured, to form a casing, with a front side-plate having a handle, side-plates 23 on the left and right, and a back side-plate 25. A grip 14 serving as an operation unit is arranged to the inner surface of the side-plate 23 of the sheet storage unit 6. A protrusion portion 15 serving as a stopper is externally protruded to the outer surface of the side-plate 23. The grip 14 and the protrusion portion 15 are moved up and down in conjunction with each other with a mechanism, which will be described later.

Figure 3A:
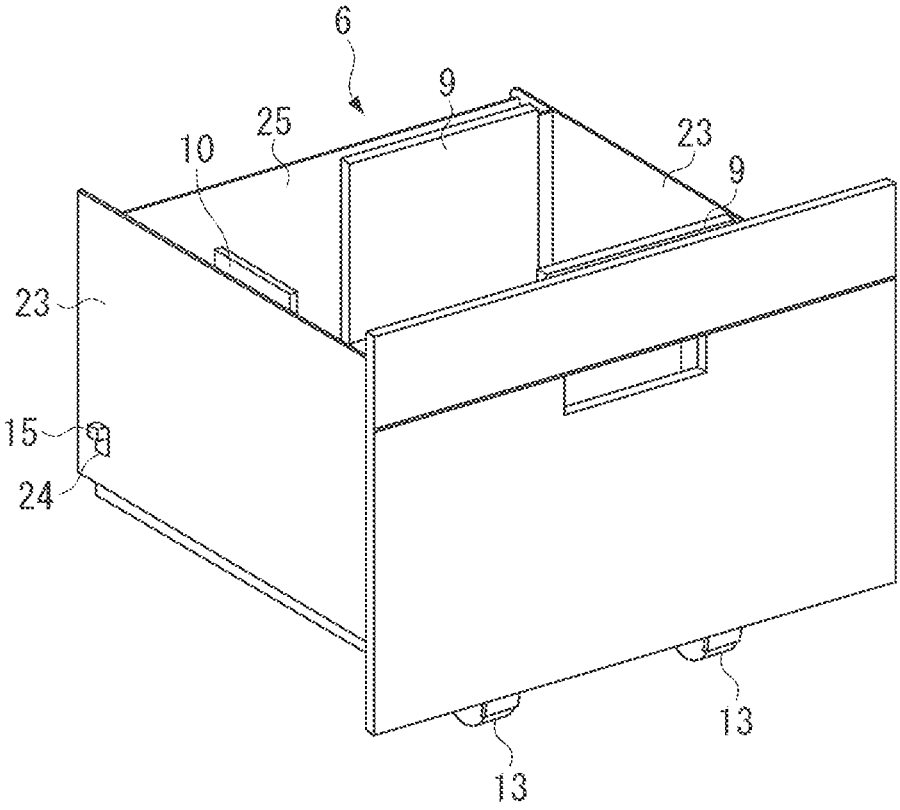
FIGS. 3A and 3B illustrate perspective views when a sheet storage unit is drawn out from the sheet feeding apparatus according to the exemplary embodiment of the present invention.
Figure 3B:
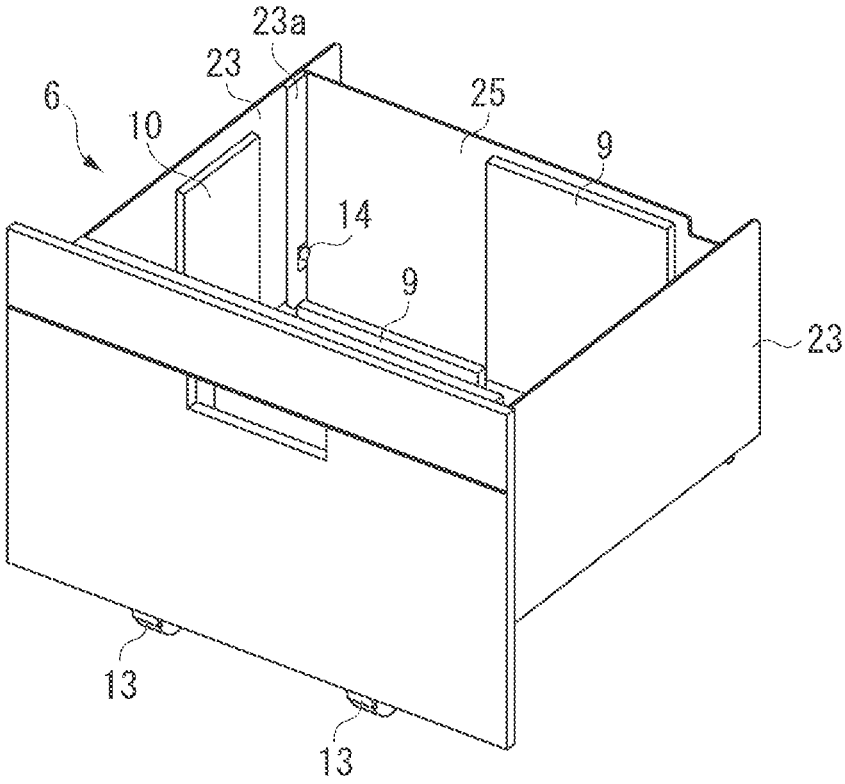

Referring to FIG. 3B, the grip 14 is disposed in the down direction of the side-plate 23 near the back side-plate 25 of the sheet storage unit 6. Therefore, a user operates the grip 14 only when the amount of stacked sheets S is small (when the height of stacked sheets is lower than that of the height of the grip 14).

Figure 4A:
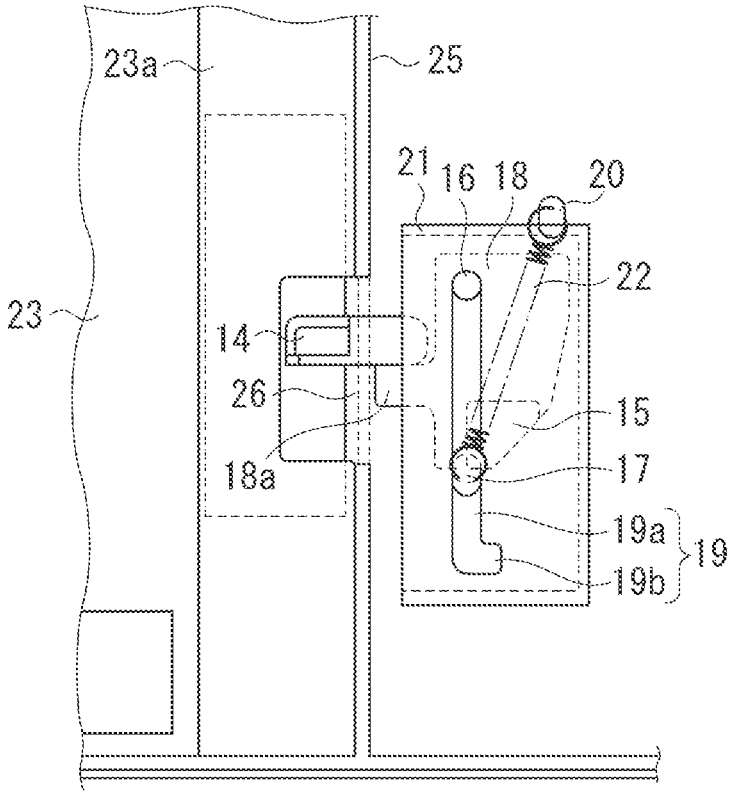
FIGS. 4A and 4B illustrate front views of a main portion of an attachment/detachment operation unit in the sheet storage unit according to the exemplary embodiment of the present invention.
Figure 4B:
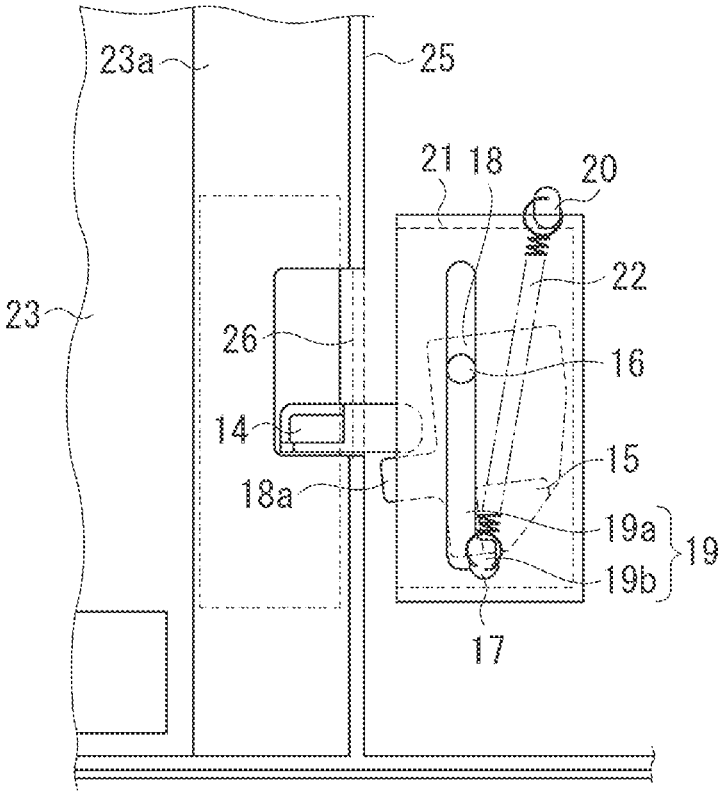
Figure 5A:
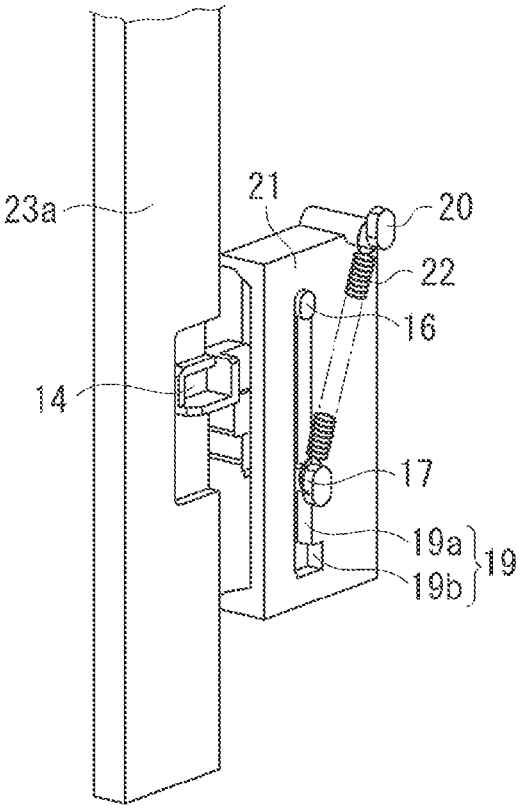
FIGS. 5A and 5B illustrate perspective views of the attachment/detachment operation unit in the sheet storage unit according to the exemplary embodiment of the present invention.
Figure 5B:
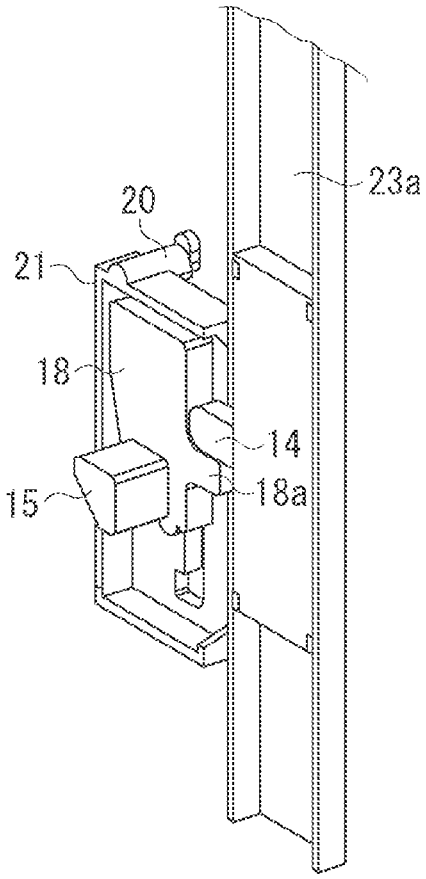

The grip 14 and the protrusion portion 15 are specifically described with reference to FIGS. 4A and 4B and FIGS. 5A and 5B. FIGS. 4A and 4B illustrate cross-sectional views of the sheet storage unit 6 near the grip 14. FIGS. 5A and 5B illustrate perspective views of parts engaging the stop release operation of the sheet storage unit 6 at the similar portions in FIGS. 4A and 4B.

The side-plate 23 of the sheet storage unit 6 includes a grip holding plate 23*a* that holds the grip 14 to be movable up and down. Further, the side-plate 23 includes a holder 21. The holder 21 includes a guide hole 19 and a spring hook portion 20. The guide hole 19 serving as a guide portion includes a straight hole 19*a* and a hook hole 19*b*. The straight hole 19*a* is vertically extended. The concave shape hook hole 19*b* serving as an engagement portion is formed in the direction perpendicular to the straight hole 19*a* from the bottom end thereof. A slider 18 having the protrusion portion 15 is slidably attached to the holder 21. Guide shafts 16 and 17 are attached to the slider 18. The guide shafts 16 and 17 are engaged with the guide hole 19 formed to the holder 21, thereby allowing the slider 18 to slide along the guide hole 19 serving as the guide portion. A spring hook portion is integrally formed to the guide shaft 17. A spring 22 (extension spring) serving as an urging member is hooked between the spring hook portion of the guide shaft 17 and the spring hook portion 20 of the holder 21.

According to this configuration, the slider 18 is urged upward with elastic force (urging force) of the spring 22. The guide shaft 16 abuts on the top end of the straight hole 19*a* of the guide hole 19, and the slider 18 stops at an upper position. The slider 18 has an arm 18*a* extended along the side plate 23. The grip 14 is engaged with an upper portion of the arm 18*a*. Further, the grip 14 is held to a grip holding plate 23*a* to be movable up and down. Furthermore, the grip 14 abuts on the arm 18*a* of the slider 18 from above with self weight thereof.

The grip holding plate 23*a* and the holder 21 are disposed in the inside of the side plate 23 forming the casing of the sheet storage unit 6. The protrusion portion 15 is externally protruded to the sheet storage unit 6 via a notch 24 (illustrated in FIG. 3A) provided to the side-plate 23 of the sheet storage unit 6. The holder 21 is arranged in the back of the back side-plate 25 forming the casing of the sheet storage unit 6. The grip 14 abuts on an upper surface of the arm 18*a* via a notch 26 formed to the back side-plate 25.

When the sheet storage unit 6 is contained in the apparatus main body 5*a*, the slider 18 is urged upward by the spring 22 (in a state in FIG. 4A). The grip 14 that abuts on the arm 18*a* of the slider 18 with the self weight is moved upward. The position is set as initial position of the slider 18 and the grip 14. The sheet storage unit 6 is drawn out from the apparatus main body 5*a*, and a user presses down the grip 14. Then, the slider 18 is also moved downward along the straight hole 19*a*. When the guide shaft 17 reaches the bottom end of the straight hole 19*a* of the guide hole 19, with component force of the spring 22 in the right direction in FIGS. 4A and 4B, the guide shaft 17 is engaged with the hook hole 19*b*, and the slider 18 is held at the bottom end of the guide hole 19 (in a state in FIG. 4B). The position is set as release position of the slider 18 and the grip 14. If force is applied to the protrusion portion 15 from the right to the left in FIG. 4B, when the slider 18 is at the release position, the guide shaft 17 is out of the hook hole 19*b*. The slider 18 is lifted upward by the spring 22. As a consequence, the grip 14 and the slider 18 are returned to the initial positions. The slider 18 and the guide hole 19 form the stop release mechanism according to the present invention. The guide shaft 17, the spring 22, and the hook hole 19*b* disposed to the slider 18 form a holding mechanism according to the present invention.

The stopper block 27 serving as a stop abutment portion and the return block 28 serving as a return abutment portion are fixed to the inside of a side surface of a containing portion of the sheet storage unit 6 in the apparatus main body 5*a* at a predetermined interval in the drawing out direction of the sheet storage unit 6. FIG. 1B illustrates positions of the stopper block 27 and the return block 28 from the front side of the apparatus. The protrusion portion 15 disposed to the sheet storage unit 6 abuts on the stopper block 27 while the sheet storage unit 6 is being drawn out, so that the stopper block 27 stops the sheet storage unit 6. The protrusion portion 15 serving as a stopper and the stopper block 27 serving as a stop contact portion form the stop mechanism according to the present invention. The return block 28 abuts on the protrusion portion 15 while the sheet storage unit 6 is pressed and contained in the containing portion, so that the return block 28 returns the slider 18 and the grip 14 from the release positions to the initial positions. The protrusion portion 15 serving as the stopper and the return block 28 form the return mechanism according to of the exemplary embodiment.

Subsequently, a description is given of a proportional relationship between the protrusion portion 15, the stopper block 27, and the return block 28. FIGS. 6A to 6F illustrate the protrusion portion 15, the stopper block 27, and the return block 28 in the side view of the apparatus. In FIGS. 6A to 6F, the right direction corresponds to the front side of the apparatus (i.e., the drawing out direction of the sheet storage unit 6). The stopper block 27 is arranged on the front side of the apparatus main body 5*a* at a position possible to abut on the protrusion portion 15 in a state the slider 18 is at the initial position. The return block 28 is arranged on the back side of the apparatus main body 5*a* at a position possible to abut on the protrusion portion 15 in a state the slider 18 is at the release position. In other words, when the slider 18 is at the initial position, the protrusion portion 15 is at a first position. At the first position, the sheet storage unit 6 is drawn out. Then, the sheet storage unit 6 abuts on the stopper block 27 serving as a stop abutment portion during the drawing out operation, and is stopped. When the slider 18 is at the release position, the protrusion portion 15 is at a second position. At the second position, the sheet storage unit 6 is attached into the apparatus main body 5*a*. Then, the sheet storage unit 6 abuts on the return block 28 during the attachment, and the protrusion portion 15 is returned from the second position to the first position.

Figure 6A:
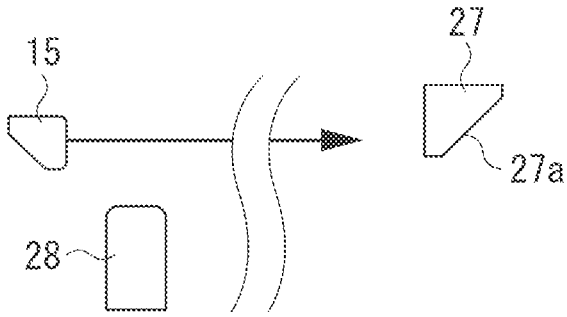
FIGS. 6A to 6F illustrate positional relationships among a protrusion portion, a stopper block and a return block in the attachment/detachment operation unit in the sheet storage unit according to the exemplary embodiment of the present invention.
Figure 6B:
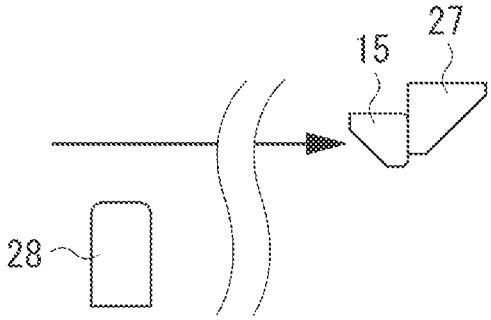

Specifically, the sheet storage unit 6 is drawn out from a complete containing state (in a state in FIG. 6A). Referring to FIG. 6B, the protrusion portion 15 serving as the stop mechanism abuts on the stopper block 27. Thus, the sheet storage unit 6 is usually drawn out with a constant amount and is stopped. It is possible to prevent the sheet storage unit 6 having the stack plate 8 on which a large amount of the sheets S is stacked from carelessly being drawing out. Further, it is possible to prevent the sheet storage unit 6 from being dropped to cause an impact to the setting surface, or prevent the sheet storage unit 6 from being damaged.

Figure 6C:
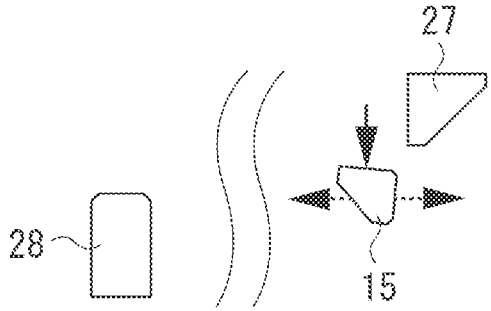

On the other hand, for the purpose of exchange of parts in the apparatus, the sheet storage unit 6 is required to completely be detached from the apparatus main body 5*a* of the sheet feeding apparatus 5. In this case, the user draws out the sheet storage unit 6 from the containing portion in the apparatus main body 5*a*, and pushes the grip 14 in the sheet storage unit 6 downwards. Thus, the slider 18 serving as the stop release mechanism falls along the guide hole 19, and the protrusion portion 15 is thereby moved downward. Referring to FIG. 6C, the abutment state of the protrusion portion 15 on the stopper block 27 is release, so that the sheet storage unit 6 can be detached from the apparatus main body 5*a*.

The grip 14 is arranged downward to the inside of the sheet storage unit 6. Therefore, only when the amount of the sheets S is small, the grip 14 is operated. The user must take out the sheets S to reduce the amount of stacked sheets S, since the user takes out the sheets S from the sheet storage unit 6 to expose and operate the grip 14. The weight of the sheets S is reduced and it is thus possible to improve the drawing out operability of the sheet storage unit 6. When the grip 14 serving as the operation unit is lowered, the guide shaft 17 of the slider 18 serving as the holding mechanism thus engages the hook hole 19*b*. The protrusion portion 15 is consequently held downward. The user may not continuously hold the grip 14 to the release position with manual operation during the detachment operation of the sheet storage unit 6. In other words the protrusion portion 15 is kept in a release state with the holding mechanism without applying force by the user. The user can detach the sheet storage unit 6 with holding thereof tightly, and the detachment operability becomes preferable.

Figure 6D:
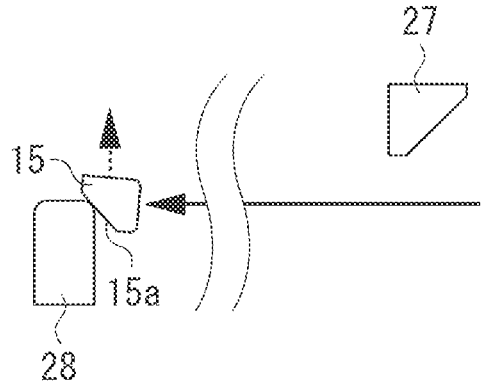
Figure 6E:
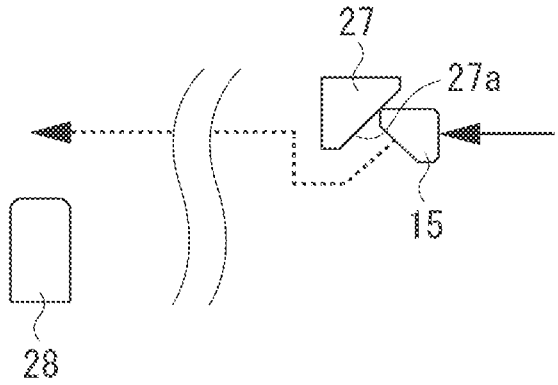

Next, the user detaches the sheet storage unit 6 once and then attaches the sheet storage unit 6 to the apparatus main body 5*a*. Referring to FIG. 6D, with the holding mechanism, the protrusion portion 15 is in the release state not abutting on the stopper block 27. The protrusion portion 15 passes down through the stopper block 27. When the sheet storage unit 6 is attached, an inclined surface 15*a* of the protrusion portion 15 abuts on the return block 28. Thus, the guide shaft 17 is detached from the hook hole 19*b*, and the slider 18 and the grip 14 are returned to the initial positions with the spring 22. By returning to the initial position, when the sheet storage unit 6 is drawn out again, the protrusion portion 15 abuts on the stopper block 27, and is stopped.

If some force is applied to the protrusion portion 15 while the sheet storage unit 6 is detached and the slider 18 is returned to the initial position, the following operation is performed. Specifically, referring to FIG. 6E, the protrusion portion 15 abuts on an inclined surface 27*a* at an abutment release portion arranged to the front side of the stopper block 27 and is pressed down. Further, the protrusion portion 15 is attached while bypassing the stopper block 27. When the protrusion portion 15 is pressed down and the stopper block 27 is bypassed, force is applied to the protrusion portion 15 in the left direction in FIGS. 4A and 4B. If the guide shaft 17 reaches the bottom end of the spring 22, the guide shaft 17 is not hooked to the hook hole 19*b*. Thus, when the protrusion portion 15 passes by the stopper block 27, the slider 18 and the grip 14 are returned to the initial positions by the elastic force of the spring 22.

Figure 6F:
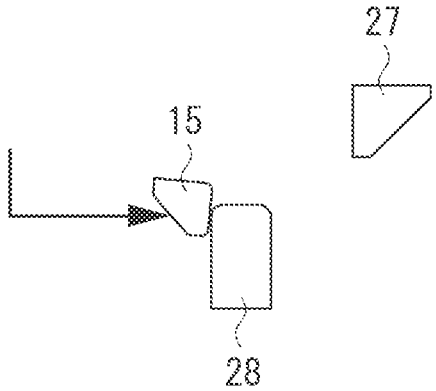

The user may not perform the operation for returning the slider 18 and the grip 14 to the initial positions. The return block 28 is arranged near the protrusion portion 15 in a state where the sheet storage unit 6 is completely contained in the apparatus main body 5*a*. Referring to FIG. 6F, when the return block 28 is located near the front side, if the user presses down the grip 14 while the sheet storage unit 6 is partly opened, the protrusion portion 15 abuts on the return block 28 and the sheet storage unit 6 is not drawn out any more. To prevent the situation described above, the protrusion portion 15 is already set to be in front of the return block 28 when the user draws out the sheet storage unit 6 to operate the grip 14. The present invention is not limited to the present exemplary embodiment. According to the present exemplary embodiment, the attachment/detachment operation unit of the sheet storage unit 6 is set only to the left side in the front view of the apparatus. However, the similar configuration may be symmetrically set to the right side. Alternatively, the grip 14 may be integrally disposed to the slider 18. Alternatively, the stopper block 27 is arranged rotatable only when force is applied from the left direction in FIGS. 6A to 6F and when the sheet storage unit 6 is attached again in a state where the protrusion portion 15 is at the initial position, the stopper block 27 may be rotated and retreated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-264222 filed Nov. 26, 2010, which is hereby incorporated by reference herein in its entirety.

What is claimed is:

1. A sheet feeding apparatus including a sheet storage unit configured to store a sheet and being detachable by being drawn out from an apparatus main body, and a sheet feeding unit configured to feed the sheet from the sheet storage unit, the sheet feeding apparatus comprising:

a stopper disposed moveably between a first position and a second position, wherein the stopper abuts to a stop abutment portion at the first position of the stopper to stop the sheet storage unit in a middle of drawing out the sheet storage unit from the apparatus main body; and the stopper is released from an abutment to the stop abutment portion at the second position of the stopper to enable detachment of the sheet storage unit from the apparatus main body; and a holding mechanism configured to hold the stopper at the second position while the sheet storage unit is drawn out after the stop of the sheet storage unit is released; and;

a return mechanism configured to release the holding of the stopper at the second position by the holding mechanism in a middle of attaching the sheet storage unit to the apparatus main body, and to return to first position;

wherein the holding mechanism includes:

a guide portion configured to guide the stopper between the first position and second position, wherein the guide portion comprises an engagement portion with which the stopper is engaged at the second position, and an urging member configured to urge the stopper to the first position, wherein when the stopper is moved to the second position, the stopper is engaged with the engagement portion by component force of urging force from the urging member to be held at the second position.

2. The sheet feeding apparatus according to claim 1, wherein the stopper is disposed on the sheet storage unit and the stop abutment portion is disposed on the apparatus main body, wherein an operation unit configured to move the stopper from the first position to the second position, and wherein the engagement portion is engaged with the stopper when the stopper is moved to the second position by the operation unit, and holds the stopper to the second position by the holding mechanism.

3. The sheet feeding according to claim 2, wherein the stopper is a protrusion portion that is externally protruded from the sheet storage unit, wherein the stop abutment portion is arranged at a position at which the protrusion portion abuts thereon while the sheet storage unit in the apparatus main body is being drawn out, and wherein the operation unit moves the protrusion portion to be away from the stop abutment portion.

4. The sheet feeding apparatus according to claim 2, wherein the return mechanism is disposed on the apparatus main body, and further comprises a return abutment portion configured to move the stopper from the second position to the first position when the stopper abuts on the return abutment portion while the sheet storage unit is being attached to the apparatus main body.

5. The sheet feeding apparatus according to claim 3, wherein, if the stopper is at the first position when the sheet storage unit is attached to the apparatus main body, an inclined surface is disposed on the stop abutment portion so that the stopper abuts on the inclined surface and bypasses the stop abutment portion.

6. The sheet feeding apparatus according to claim 3, wherein, if the stopper is at the first position when the sheet storage unit is attached to the apparatus main body, the stop abutment portion is pressed by the stopper and is rotated and retreated when the stopper abuts on the stop abutment portion.

7. The sheet feeding apparatus according to claim 2, wherein the operation unit is included in the sheet storage unit, and is disposed being exposed at an operable position when the amount of stacked sheets is small.

8. The sheet feeding apparatus according to claim 2, wherein the engagement portion guide portion further comprises a concave shape engagement portion, and wherein the stopper is engaged with the concave shape engagement portion and the stopper is thus held at the second position by urging force from the urging member.

9. An image forming apparatus including a sheet storage unit configured to store a sheet and being detachable by being drawn out from an apparatus main body, a sheet feeding unit configured to feed the sheet from the sheet storage unit, and an image forming unit configured to form an image to the sheet fed from the sheet feeding unit, the image forming apparatus comprising:

a stopper disposed moveably between a first position and a second position, wherein the stopper abuts to a stop abutment portion at the first position of the stopper to stop the sheet storage unit in a middle of drawing out the sheet storage unit from the apparatus main body and;

the stopper is released from an abutment to the stop abutment portion at the second position of the stopper to enable detachment of sheet storage unit from the apparatus main body;

a holding mechanism configured to hold the stopper at the second position while the sheet storage unit is drawn out after the stop of the sheet storage unit is released; and a return mechanism configured to release the holding of the stopper at the second position by the holding mechanism in a middle of attaching the sheet storage unit to the apparatus main body, and return the stopper to the first position wherein the holding mechanism includes:

a guide portion configured to guide the stopper between the first position and second position, wherein the guide portion comprises an engagement portion with which the stopper is engaged at the second position, and an urging member configured to urge the stopper to the first position, wherein when the stopper is moved to the second position, the stopper is engaged with the engagement portion by component force of urging force from the urging member to be held at the second position.

10. The image forming apparatus according to claim 9, wherein the stopper is disposed on the sheet storage unit and the stop abutment portion is disposed on the apparatus main body, wherein an operation unit is configured to move the stopper from the first position to the second position, and wherein the engagement portion is engaged with the stopper when the stopper is moved to the second position by the operation unit, and holds the stopper to the second position by the holding mechanism.

11. The image forming apparatus according to claim 10, wherein the stopper is a protrusion portion that is externally protruded from the sheet storage unit, wherein the stop abutment portion is arranged at a position at which the protrusion portion abuts thereon while the sheet storage unit in the apparatus main body is being drawn out, and wherein the operation unit moves the protrusion portion to be away from the stop abutment portion.

12. The image forming apparatus according to claim 10, wherein the return mechanism is disposed on the apparatus main body, and further comprises a return abutment portion configured to move the stopper from the second position to the first position when the stopper abuts on the return abutment portion while the sheet storage unit is being attached to the apparatus main body.

13. The image forming apparatus according to claim 11, wherein, if the stopper is at the first position when the sheet storage unit is attached to the apparatus main body, an inclined surface is disposed on the stop abutment portion so that the stopper abuts on the inclined surface and bypasses the stop abutment portion.

14. The image forming apparatus according to claim 11, wherein, if the stopper is at the first position when the sheet storage unit is attached to the apparatus main body, the stop abutment portion is pressed by the stopper and is rotated and retreated when the stopper abuts on the stop abutment portion.

15. The image forming apparatus according to claim 10, wherein the operation unit is included in the sheet storage unit, and is disposed so as to be exposed at an operable position when the amount of stacked sheets is small.

16. The image forming apparatus according to claim 10, wherein the engagement portion comprises a concave shape engagement portion, and wherein the stopper is engaged with the concave shape engagement portion and the stopper is thus held at the second position by urging force from the urging member.

* * * * *